US006257871B1

(12) United States Patent
Weiss et al.

(10) Patent No.: US 6,257,871 B1
(45) Date of Patent: Jul. 10, 2001

(54) CONTROL DEVICE FOR A GAS-FIRED APPLIANCE

(75) Inventors: Cory A. Weiss, Warren; Paul W. Droll, Oxford, both of MI (US)

(73) Assignee: Effikal International, Inc., Orion, MI (US)

( * ) Notice: Subject to any disclaimer, the term of this patent is extended or adjusted under 35 U.S.C. 154(b) by 0 days.

(21) Appl. No.: 09/533,310

(22) Filed: Mar. 22, 2000

(51) Int. Cl.[7] ..... F23J 11/00
(52) U.S. Cl. ..... 431/20; 431/80
(58) Field of Search ..... 431/20, 42, 6, 431/80, 82; 126/285 B; 236/1 G, 1 A

(56) References Cited

U.S. PATENT DOCUMENTS

| | | | | |
|---|---|---|---|---|
| 2,349,443 | * | 5/1944 | McCarty | 431/80 |
| 4,204,833 | * | 5/1980 | Kmetz et al. | 431/20 |
| 4,406,396 | * | 9/1983 | Habegger | 431/20 |
| 4,550,874 | * | 11/1985 | Clouser et al. | 431/20 |
| 4,778,378 | | 10/1988 | Dolnick et al. | 431/79 |
| 4,846,400 | * | 7/1989 | Crouse | 431/20 |
| 5,393,221 | * | 2/1995 | McNally | 431/20 |

* cited by examiner

*Primary Examiner*—Sara Clarke
(74) *Attorney, Agent, or Firm*—Dykema Gossett PLLC

(57) ABSTRACT

A device for controlling a gas-fired appliance having a thermoelectric device such as a thermopile is provided and, particularly, for controlling a damper and a main burner valve within a gas-fired appliance. The device includes a motor having a shaft extending therefrom for connection to a plate of a damper. The device further includes a control circuit that selectively transmits current from the thermoelectric device to the motor and to the main burner valve of the appliance. The control circuit includes a temperature sensor and a plurality of single pole double throw switches. When the temperature sensor determines that the temperature of a medium such as water or air is below a predetermined temperature, current is directed through the switches to the motor in order to open the damper. Once the damper is opened, current is redirected through the switches to the valve to open the valve. When the predetermined temperature is reached, current is again directed to the motor to close the damper and trap residual heat within the appliance.

22 Claims, 4 Drawing Sheets

CONTROL DEVICE FOR A GAS-FIRED APPLIANCE

BACKGROUND OF THE INVENTION

1. Field of the Invention

This invention relates to gas-fired appliances such as water heaters, space heaters and fireplaces and, more particularly, to a device for controlling components commonly found in gas-fired appliances, namely, dampers and valves.

2. Disclosure of Related Art

In a conventional gas-fired appliance a gas pipe delivers a fuel gas, such as natural gas, from a fuel source to both a pilot burner and to a main burner that are disposed proximate, or within, a combustion chamber. The gas pipe includes a pair of valves disposed within the gas pipe. The first valve controls the flow of fuel gas from the fuel source to the pilot burner. The second valve controls the flow of fuel gas to the main burner.

The pilot burner is provided to ignite fuel gas entering the main burner and may comprise a standing pilot burner or an intermittent pilot burner. If the pilot flame is extinguished for any reason, the valve between the fuel source and the pilot burner must be closed to prevent a buildup of gas within the appliance and the possibility of a fire or an explosion. As a result, conventional gas-fired appliances typically include a safety mechanism that detects the presence of the pilot flame and closes the valve between the fuel source and the pilot burner if the pilot flame is extinguished. One conventional safety mechanism incorporates a thermopile disposed proximate the pilot burner. The thermopile generates an electrical current in the presence of the pilot flame and the current is used to control the opening and closing of the valve between the fuel source and the pilot burner.

Conventional gas-fired appliances also typically include an exhaust vent or flue to direct emissions resulting from combustion away from the combustion chamber and into an area, such as the outdoors, where the emissions can dissipate. Exhaust vents, however, also allow heat to escape from the appliance thereby reducing the efficiency of the appliance. As a result, conventional gas-fired appliances typically include dampers disposed within the exhaust vent. The damper opens prior to ignition of the main burner to allow emissions from combustion to be evacuated from the appliance. When the main burner is extinguished, the damper closes to trap the remaining heat.

Conventional gas-fired appliances suffer from several drawbacks. The use of dampers and other electrically-actuated components within conventional appliances has often necessitated connecting the appliance to an external power source such as an A.C. power line. For example, many conventional appliances use a motor to open and close the damper wherein the motor is powered by an external power source. As a result, conventional appliances require additional components, are relatively expensive, and are dependent upon external electrical power even when sufficient fuel gas is present for operation of the appliance.

There is thus a need for a device for controlling a gasfired appliance that will minimize or eliminate one or more of the above-mentioned deficiencies.

SUMMARY OF THE INVENTION

The present invention provides a device for controlling a gas-fired appliance such as a water heater, space heater, or fireplace. In particular, the present invention provides a device for controlling the damper and the main burner valve in a gas-fired appliance by using current generated by a thermoelectric device within the appliance. The thermoelectric device may comprise a thermopile disposed proximate a pilot burner in the appliance.

A device in accordance with the present invention for controlling a damper and a main burner valve in a gas-fired appliance having a thermoelectric device includes several elements. First, the inventive device includes a motor having a shaft extending therefrom for connection to a plate of the damper. Second, the device includes a control circuit for selectively transmitting current generated by the thermoelectric device to the motor and to the main burner valve. The control circuit may include a temperature sensor and a plurality of switches that direct current to the motor and the main burner valve. When the temperature sensor determines that the temperature of a medium such as water or air is below a predetermined temperature, current may be directed through the switches to the motor. The motor uses the current to move the plate in the damper from a first position to a second position. The first and second positions preferably correspond to closed and open positions of the damper. Once the plate has reached the second position and the damper is open, current may be redirected through the switches to the main burner valve to open the valve and allow the introduction of fuel gas to the main burner. When the predetermined temperature is reached, current may again be directed through the switches to the motor thereby allowing the valve to close. The motor may use the current to move the plate of the damper from the second or open position to the first position or closed position to trap remaining heat within the appliance.

A device in accordance with the present invention represents a significant improvement as compared to conventional control systems for gas-fired appliances. In particular, the inventive control device derives its energy entirely from the appliance (i.e., is self-powered) and does not require a battery or external power source. As a result, a gas-fired appliance incorporating the inventive control device requires fewer components, is less expensive, and is not dependent upon external power for operation.

These and other features and objects of this invention will become apparent to one skilled in the art from the following detailed description and the accompanying drawings illustrating features of this invention by way of example.

DETAILED DESCRIPTION OF THE PREFERRED EMBODIMENT

Figure 1:
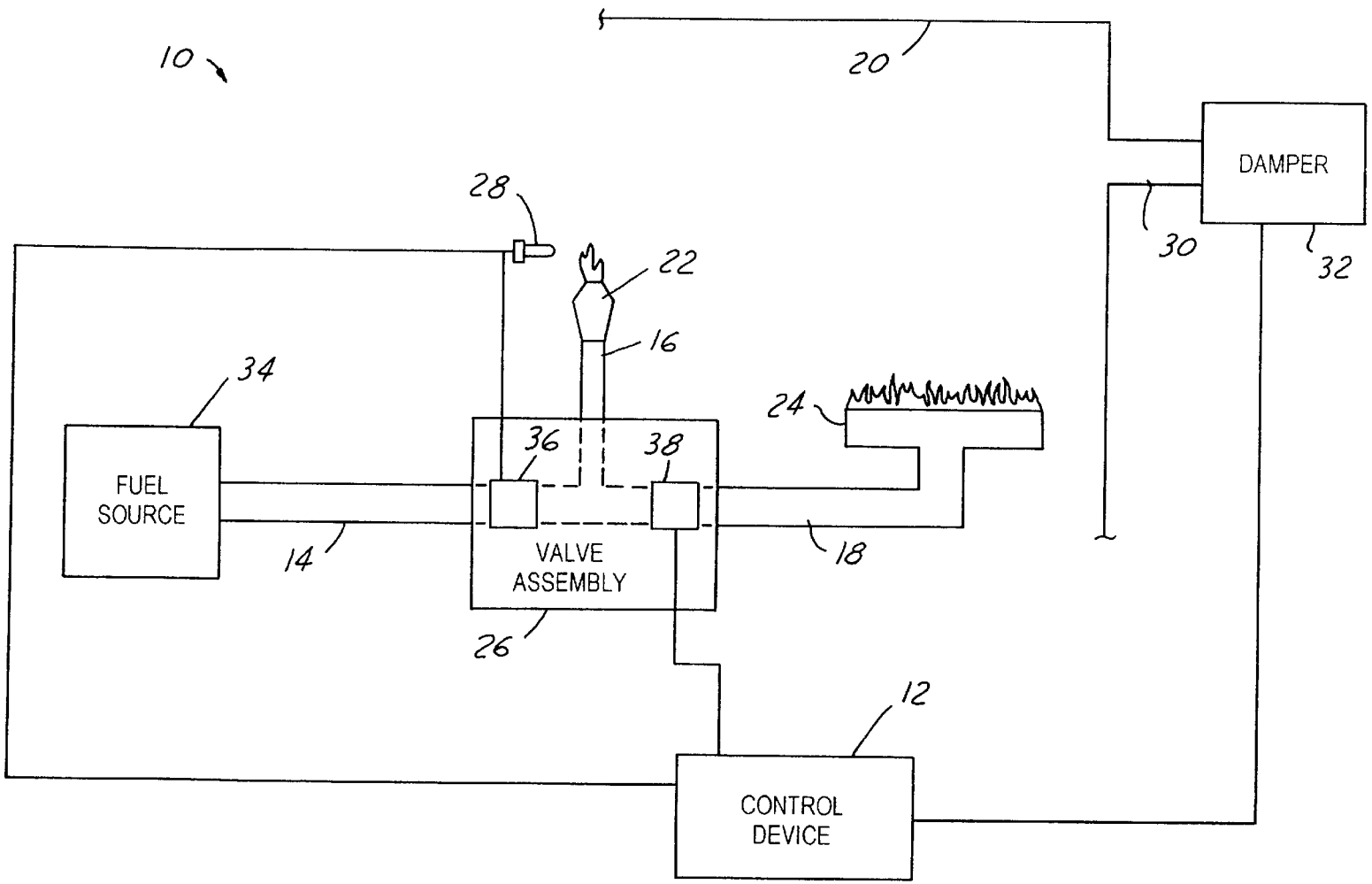
FIG. 1 is diagrammatic view illustrating a gas-fired appliance incorporating a control device in accordance with the present invention.

Referring now to the drawings wherein like reference numerals are used to identify identical components in the various views, FIG. 1 illustrate a gas-fired appliance 10 incorporating a control device 12 in accordance with the present invention. Appliance 10 may comprise a water heater, a space heater, fireplace or any other conventional gas-fired appliance. In addition to control device 12, appliance 10 may include several sections of gas pipe 14, 16, 18, a combustion chamber 20, a pilot burner 22, a main burner 24, a valve assembly 26, a thermoelectric device 28, an exhaust vent 30, and a damper 32.

Pipe sections 14, 16, 18 are provided to direct fuel gas received from a fuel source 34 to the pilot and main burners 22, 24 within appliance 10 and are conventional in the art. Section 14 is connected at one end to valve assembly 26 and at another end to fuel source 34. Fuel source 34 may be located at a distance remote from appliance 10 and additional sections of gas pipe may be used to connect fuel source 34 to pipe section 14. The fuel gas supplied by fuel source 34 may comprise natural gas, propane, butane or other conventional fuel gases. Section 16 is also connected at one end to valve assembly 26 and at another end to pilot burner 22. Finally, section 18 is also connected at one end to valve assembly 26 and at another end to main burner 24.

Combustion chamber 20 provides a space for burning the fuel gas provided by fuel source 34. Chamber 20 is conventional in the art and encompasses at least main burner 24.

Pilot burner 22 is provided to ignite main burner 24 upon the introduction of fuel gas to main burner 24. Pilot burner 22 is conventional in the art and preferably comprises a standing pilot burner (i.e., a continuously operating pilot burner).

Main burner 24 is provided to generate heat within appliance 10 to increase the temperature of water, air, or another medium depending upon the purpose for which appliance 10 is designed. Main burner 24 is also conventional in the art.

Valve assembly 26 is provided to control the passage of fuel gas from fuel source 34 to pilot burner 22 and main burner 24. Valve assembly 26 is conventional in the art and may comprise one of the 7000MVR Series of heating controls sold by Robertshaw Controls Company of Long Beach, Calif. Assembly 26 includes a pilot burner valve 36 and a main burner valve 38. Pilot burner valve 36 is disposed between fuel source 34 and pilot burner 22. Main burner valve 38 is disposed between fuel source 34 and main burner 24. As illustrated in FIG. 1, in order for fuel gas to reach main burner 24, the fuel gas must pass through pilot burner valve 36 in addition to main burner valve 38. Accordingly, the closure of pilot burner valve 36 will prevent fuel gas from reaching main burner 24.

Thermoelectric device 28 is provided to detect the presence of the pilot flame and to generate current for use by the electrically actuated components of appliance 10. In particular, and in accordance with the present invention, device 28 provides power to control device 12 for use in controlling damper 32 and main burner valve 38. In a preferred embodiment, thermoelectric device 28 comprises one or more thermopiles. Thermopiles are conventional in the art and may comprise the Model No. Q313 thermopile sold by Honeywell, Inc. of Morristown, N.J. Device 28 is disposed proximate pilot burner 22 and generates current in the presence of a pilot flame. The current generated by device 28 may be used to control pilot burner valve 36. In particular, the current may be used to power a solenoid to maintain valve 36 in an open position. If the pilot flame is extinguished, device 28 will cease generating current and valve 36 will close to prevent a further buildup of unburned gas within appliance 10. In accordance with the present invention, the current generated by device 28 may also be provided to control device 12 for use in controlling damper 32 and main burner valve 38 as described in greater detail hereinbelow.

Exhaust vent 30 is provided to evacuate emissions, generated as a result of the combustion process, from the combustion chamber 20 in appliance 10. Vent 30 is conventional in the art. Vent 30 is coupled at one end to the combustion chamber 20 of appliance 10 and at a second end to a venting area, such as the outdoors, where emissions from the combustion process can be dissipated.

Figure 2:
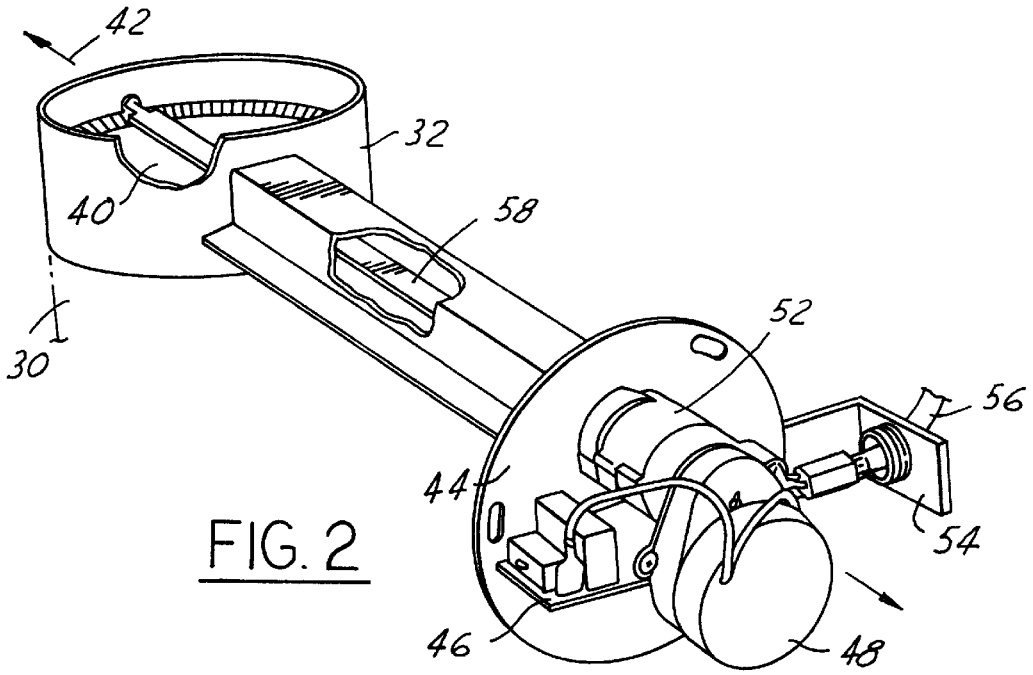
FIG. 2 is a perspective view of several components of the gas-fired appliance of FIG. 1.

Damper 32 is provided to control the evacuation of heat from combustion chamber 20 through vent 30 in order to improve the efficiency of appliance 10. Damper 32 is conventional in the art and may comprise the Model No. RVGP-KSF damper sold by Effikal International, Inc., assignee of the present invention. Referring to FIG. 2, damper 32 is supported within vent 30 and includes a plate 40 that is rotatable about an axis 42 extending transversely to the longitudinal axis of vent 30 and to the direction of airflow through vent 30. As plate 40 rotates about axis 42, plate 40 assumes a plurality of angular positions including a closed position (illustrated in FIG. 2) in which damper 32 allows a minimum outflow of air from combustion chamber 20 and an open position in which damper 32 allows a maximum outflow of air from combustion chamber 20. Plate 40 preferably assumes a closed position immediately after main burner 24 is extinguished in order to reduce or eliminate the evacuation of heat through vent 30. Plate 40 preferably assumes an open position immediately prior to ignition of main burner 24 in order to allow the evacuation of emissions generated by the combustion process.

Figure 5:
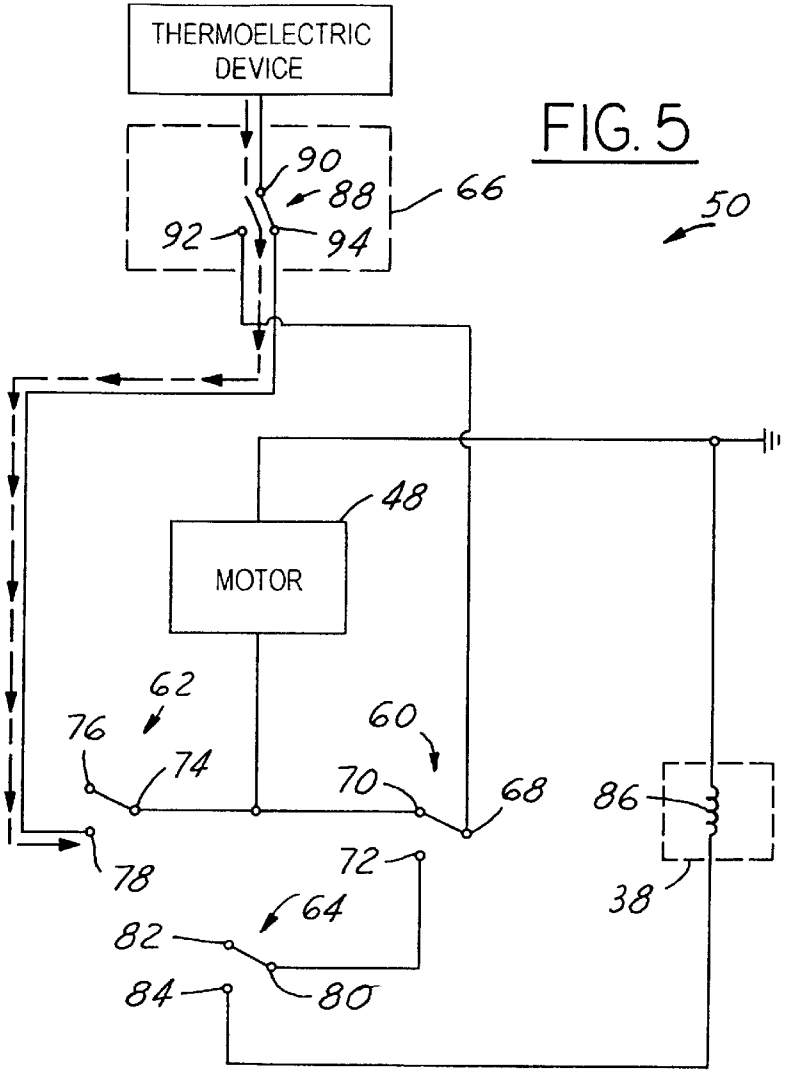

Control device 12 is provided to control the operation of damper 32 and main burner valve 38 using the current generated by thermoelectric device 28. Referring to FIGS. 2 and 5, a control device 12 in accordance with the present invention may include a mounting plate 44, a printed circuit board 46, a motor 48, a control circuit 50, and a cam 52.

Referring now to FIG. 2, mounting plate 44 provides support for several of the components of control device 12 and provides a means for mounting device 12 within appliance 10. Plate 44 may be made from a variety of conventional metals and plastics. Plate 44 may include an extension arm 54 that may be used to support a wire harness 56.

Circuit board 46 provides a mounting surface for several of the components control circuit 50 and further provides conduction paths to direct current between motor 48 and control circuit 50. Circuit board 46 is conventional in the art.

Motor 48 is provided to move plate 40 and, in particular, to rotate plate 40 about axis 42, from a first position to a second position and from the second position to the first position. The first and second positions may correspond to a closed position of damper 32 and to an open position of damper 32, respectively. Motor 48 is conventional in the art and may comprise a permanent magnet motor. Motor 48 may be mounted to mounting plate 44 and may further be connected to circuit board 46. Motor 48 includes a shaft 58 extending therefrom along axis 42 to which plate 40 of damper 32 is drivingly connected. Plate 40 may be directly connected to shaft 58 or may be indirectly connected to shaft 58 through, for example, a series of gears as is known in the art.

Control circuit 50 is provided to selectively transmit current to main burner valve 38 and to motor 48 to control the operation of main burner 24 and damper 32, respectively. Referring to FIG. 5, circuit 50 may include first, second, and third switches 60, 62, 64 and a temperature sensor 66.

Switches 60, 62, 64 are provided to direct current to main burner valve 38 and motor 48 in order to operate main burner 24 and damper 32. Switches 60, 62, 64 are conventional in the art and preferably comprise single pole, double throw switches. Switch 60 includes a common contact 68 coupled to temperature sensor 66, a first throw contact 70 coupled to motor 48, and a second throw contact 72. Switch 62 includes a common contact 74 coupled to motor 48, a first throw contact 76, and a second throw contact 78 coupled to temperature sensor 66. Switch 64 includes a common contact 80 coupled to second throw contact 72 of switch 60, a first throw contact 82, and a second throw contact 84 coupled to main burner valve 38. In particular, throw contact 84 may be coupled to a solenoid coil 86 of valve 38. Switches 60, 62, 64 may be mounted to circuit board 46. Each of switches 60, 62, 64 include a spring or other means for exerting a spring force within switches 60, 62, 64 to couple common contacts 68, 74, 80 of switches 60, 62, 64 and respective first throw contacts 70, 76, 82 of switches 60, 62, 64 in the absence of an intervening force.

Temperature sensor 66 is provided to measure the temperature of water, air, or another medium and to control the flow of current from thermoelectric device 28 responsive thereto. Sensor 66 may include a switch 88 that is responsive to a conventional thermostat, hydronic bulb, or other appropriate temperature gauge for appliance 10. Switch 88 is conventional in the art and may comprise a single pole double throw switch having a common contact 90 coupled to thermoelectric device 28, a first throw contact 92 coupled to common contact 68 of switch 60, and a second throw contact 94 coupled to second throw contact 78 of switch 62. Switch 88 may be mounted on circuit board 46. The temperature gauge used to control switch 88 may be located distant from circuit board 46 as appropriate for appliance 10 and may provide a signal indicative of the temperature of water, air or another medium through wire harness 56.

Figure 3:
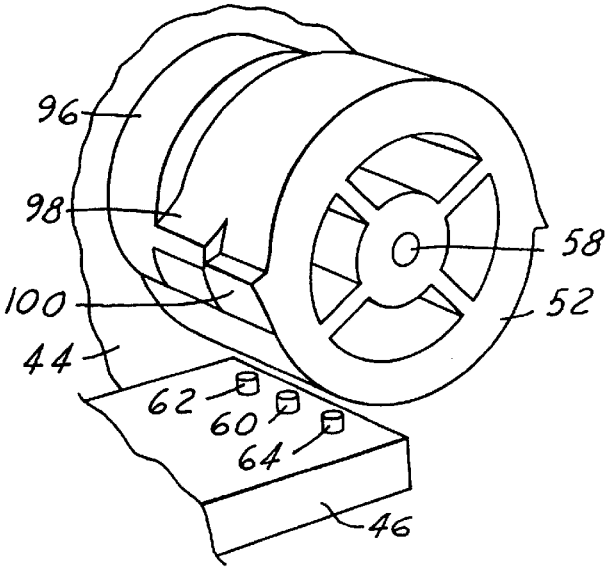
FIGS. 3–4 are perspective and plan views, respectively, of several of the components illustrated in FIG. 2.
Figure 4:
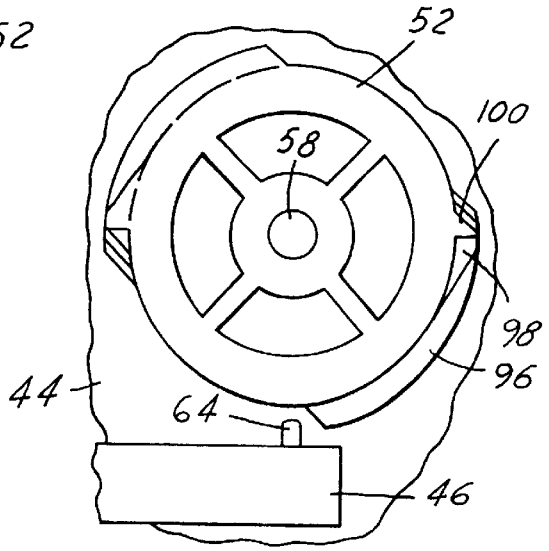

Referring to FIGS. 3 and 4, cam 52 is provided to overcome the spring force coupling common contacts 68, 74, 80 of switches 60, 62, 64 to respective first throw contacts 70, 76, 82 of switches 60, 62, 64 to thereby couple common contacts 68, 74, 80 with respective second throw contacts 72, 78, 84 of switches 60, 62, 64 as described in greater detail hereinbelow. Cam 52 may be coupled to shaft 58 for rotation therewith about axis 42 and may be mounted proximate to circuit board 46. Cam 52 includes a first cam surface 96 configured to actuate switch 62, a second cam surface 98 configured to actuate switch 60, and a third cam surface 100 configured to actuate switch 64. Each of cam surfaces 96, 98, 100 is divided into two identically-shaped angular sections disposed about the circumference of cam 52.

Referring to FIGS. 5–8, the operation of a device 12 in accordance with the present invention for controlling a gas-fired appliance 10 having a thermoelectric device 28 will now be described in greater detail. Referring to FIG. 5, prior to a call for heat by temperature sensor 66, switches 60, 62, 64, 88 within control circuit 50 will assume the illustrated positions. In particular, switch 88 of temperature sensor 66 assume a state in which common contact 90 and second throw contact 94 are electrically connected. Each of switches 60, 62, 64 will assume a state in which their respective common contacts 68, 74, 80 are electrically connected to their respective first throw contacts 70, 76, 82. As a result, any current generated by thermoelectric device 28 will be directed along the path illustrated by arrows in FIG. 5 and current will not be provided to either valve 38 or motor 48.

Figure 6:
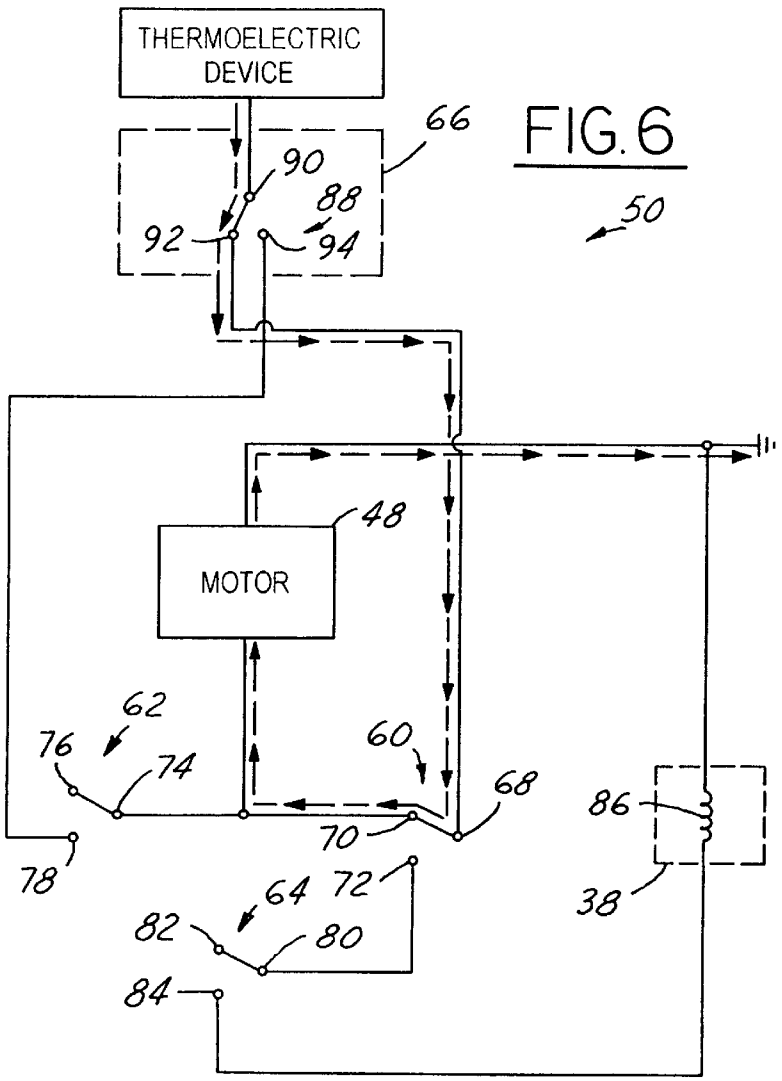
FIGS. 5–8 are schematic and block diagrams illustrating a control circuit for a control device in accordance with the present invention as well as operation of the inventive control device.

Referring to FIG. 6, when a temperature gauge within temperature sensor 66 detects that the temperature of the measured medium has fallen below a predetermined level, switch 88 of sensor 66 will switch to a state in which the common contact 90 of switch 88 is electrically connected to first throw contact 92. As a result, the current generated by thermoelectric device 28 will be directed along the path illustrated by arrows in FIG. 6 and current will be provided to motor 48. The current will cause motor 48 to rotate shaft 58, and consequently, plate 40 of damper 32, from a first position to a second position. In particular, plate 40 will preferably rotate from a closed position to an open position in preparation for venting emissions of the combustion process.

Figure 7:
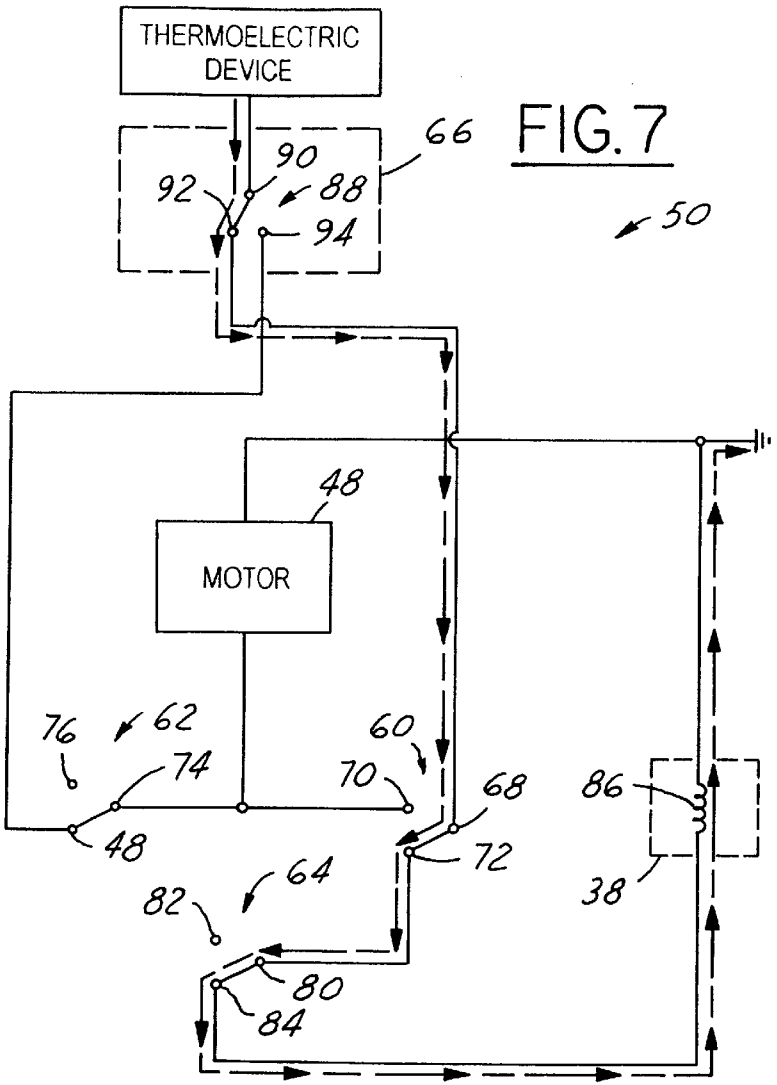

Referring to FIG. 2, rotation of shaft 58 also causes rotation of cam 52. Referring to FIG. 7, cam 52 is configured so as to overcome the spring force within switches 60, 62, 64 and couple common contacts 68, 74, 80 of switches 60, 62, 64 to respective second throw contacts 72, 78, 84 of switches 60, 62, 64 once motor shaft 58, plate 40, and cam 52 reach a predetermined angular position-preferably corresponding to an open position for damper 32. Accordingly, as plate 40 of damper 32 rotates into an open position, cam 52 forces each of switches 60, 62, 64 into a another switching state in which the respective common contacts 68, 74, 80 of switches 60, 62, 64 are coupled to the respective second throw contacts 72, 78, 84 of switches 60, 62, 64. As a result, once damper 32 has assumed the open position, current is directed along the path illustrated by arrows in FIG. 7 from thermoelectric device 28 to main burner valve 38. Valve 38 is thereby opened and fuel gas is supplied to main burner 24 which is then ignited by pilot burner 22. Because damper 32 is in the open position, emissions from the combustion process are evacuated through vent 30.

Figure 8:
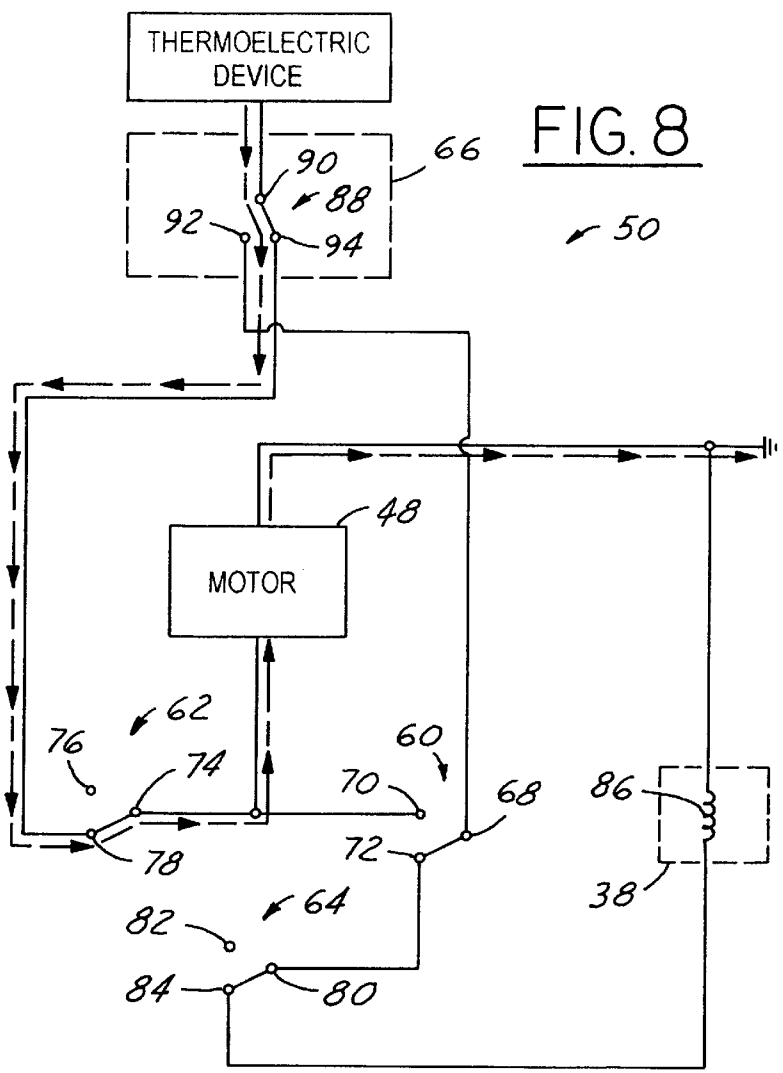

Referring now to FIG. 8, once the temperature gauge in temperature sensor 66 determines that the measured medium has attained a predetermined temperature, switch 88 of temperatures sensor 66 assumes a state in which common contact 90 is electrically connected to second throw contact 94. As a result, current is directed along the path illustrated by arrows in FIG. 8 from thermoelectric device 28 to motor 48. The current causes motor 48 to rotate shaft 58, and consequently, plate 40 of damper 32, from the second position to the first position. In particular, plate 48 preferably rotates from the open position to the closed position in order to trap the heat remaining from the combustion process. Rotation of shaft 58 also causes rotation of cam 52. Cam 52 is configured such that, as shaft 58, plate 40, and cam 52 attain the first position, cam 52 allows the spring force of switches 60, 62, 64 to return switches 60, 62, 64 to a state in which common contacts 68, 74, 80 of switches 60, 62, 64 are electrically connected to respective first throw contacts 70, 76, 82 of switches 60, 62, 64. Accordingly, once motor shaft 58, plate 40, and cam 52 return to the first position, switches 60, 62, 64 will once again assume the positions set forth in FIG. 5.

A device in accordance with the present invention for controlling a gas-fired appliance-and particularly the damper and main burner valve of a gas-fired appliance-represents a significant improvement over conventional control systems. In particular, the inventive control device is powered entirely by the appliance itself and does not require a battery or an external power source such as an A.C. power line to control the damper or main burner valve.

While the invention has been particularly shown and described with reference to the preferred embodiments thereof, it is well understood by those skilled in the art that various changes and modifications can be made in the invention without departing from the spirit and scope of the invention.

What is claimed is:

1. A device for controlling a damper in a gas-fired appliance having a thermoelectric device, said device comprising:

a motor having a shaft extending therefrom for connection to a plate of said damper; and, a control circuit for selectively transmitting current generated by said thermoelectric device to said motor to move said plate from a first position to a second position and from said second position to said first position.

2. The device of claim 1 wherein said thermoelectric device comprises a thermopile.

3. The device of claim 1 wherein said thermoelectric device is disposed proximate a standing pilot burner.

4. The device of claim 1 wherein said first position corresponds to a closed position of said damper and said second position corresponds to an open position of said damper.

5. The device of claim 1 wherein said control circuit includes:

a temperature sensor;

means for directing current from said thermoelectric device to said motor to move said plate from said first position to said second position when said temperature sensor determines that a temperature of a medium is below a predetermined temperature; and, means for directing current from said thermoelectric device to said motor to move said plate from said second position to said first position when said temperature sensor determines that said temperature equals said predetermined temperature.

6. The device of claim 1 wherein said control circuit includes:

a temperature sensor;

a first switch having a common contact coupled to said temperature sensor, a first throw contact coupled to said motor and a second throw contact; and, a second switch having a common contact coupled to said motor, a first throw contact, and a second throw contact coupled to said temperature sensor.

7. The device of claim 6 wherein said temperature sensor includes a third switch having a common contact coupled to said thermoelectric device, a first throw contact connected to said common contact of said first switch, and a second throw contact connected to said second throw contact of said second switch.

8. The device of claim 6, further comprising a cam coupled to said shaft for rotation therewith, said cam configured to couple said common contacts of said first and second switches with corresponding second throw contacts of said first and second switches when said plate of said damper is in said second position.

9. A device for controlling a damper and a main burner valve in a gas-fired appliance having a thermoelectric device, said device comprising:

a motor having a shaft extending therefrom for connection to a plate of said damper; and, a control circuit for selectively transmitting current generated by said thermoelectric device to said motor and to said main burner valve.

10. The device of claim 9 wherein said thermoelectric device comprises a thermopile.

11. The device of claim 9 wherein said thermoelectric device is disposed proximate a standing pilot burner.

12. The device of claim 9 wherein said motor moves said plate from a first position to a second position and from said second position to said first position.

13. The device of claim 12 wherein said first position corresponds to a closed position of said damper and said second position corresponds to an open position of said damper.

14. The device of claim 9 wherein said control circuit includes:

a temperature sensor;

means for directing current from said thermoelectric device to said motor to move said plate from a first position to a second position and for directing current from said thermoelectric device to said main burner valve to open said main burner valve when said temperature sensor determines that a temperature of a medium is below a predetermined temperature; and, means for directing current from said thermoelectric device to said motor to move said plate from said second position to said first position when said temperature sensor determines that said temperature equals said predetermined temperature.

15. The device of claim 9 wherein said control circuit includes:

a temperature sensor;

a first switch having a common contact coupled to said temperature sensor, a first throw contact coupled to said motor and a second throw contact;

a second switch having a common contact coupled to said motor, a first throw contact, and a second throw contact coupled to said temperature sensor; and, a third switch having a common contact coupled to said second throw contact of said first switch, a first throw contact, and a second throw contact coupled to said main burner valve.

16. The device of claim 15 wherein said temperature sensor includes a fourth switch having a common contact coupled to said thermoelectric device, a first throw contact connected to said common contact of said first switch, and a second throw contact connected to said second throw contact of said second switch.

17. The device of claim 15, further comprising a cam coupled to said shaft for rotation therewith, said cam configured to couple said common contacts of said first, second, and third switches with corresponding second throw contacts of said first, second, and third switches when said plate of said damper is in a predetermined position.

18. A device for controlling a damper and a main burner valve in a gas-fired appliance having a thermoelectric device, said device comprising:

a motor having a shaft extending therefrom for connection to a plate of said damper;

a temperature sensor coupled to said thermoelectric device;

a first switch having a common contact coupled to said temperature sensor, a first throw contact coupled to said motor, and a second throw contact;

a second switch having a common contact coupled to said motor, a first throw contact, and a second throw contact coupled to said temperature sensor;

a third switch having a common contact coupled to said second throw contact of said first switch, a first throw contact, and a second throw contact coupled to said main burner valve.

19. The device of claim 18 wherein said thermoelectric device comprises a thermopile.

20. The device of claim 18 wherein said thermoelectric device is disposed proximate a standing pilot burner.

21. The device of claim 18 wherein said temperature sensor includes a fourth switch having a common contact coupled to said thermoelectric device, a first throw contact coupled to said common contact of said first switch, and a second throw contact coupled to said second throw contact of said second switch.

22. The device of claim 18, further comprising a cam coupled to said shaft for rotation therewith, said cam configured to couple said common contacts of said first, second, and third switches with corresponding second throw contacts of said first, second, and third switches when said plate is in a predetermined position.

* * * * *